United States Patent [19]

Jouffray

[11] 3,930,583

[45] Jan. 6, 1976

[54] BALANCING SYSTEM FOR HIGH CAPACITY CRANES

[75] Inventor: Maurice Jouffray, Bron, France

[73] Assignee: Creusot-Loire, Paris, France

[22] Filed: Sept. 23, 1974

[21] Appl. No.: 508,203

Related U.S. Application Data

[63] Continuation-in-part of Ser. No. 384,175, July 31, 1972, abandoned.

[30] Foreign Application Priority Data

Aug. 9, 1972 France ..... 72.28714

[52] U.S. Cl. ..... 212/49; 212/8 R

[51] Int. Cl.[2] ..... B66C 23/72

[58] Field of Search..... 212/8 R, 48, 49, 69, 58 R, 212/58 A, 59 R, 59 A, 47

[56] References Cited

UNITED STATES PATENTS

| | | | |
|---|---|---|---|
| 2,139,960 | 12/1938 | Kauffman | 212/69 |
| 2,589,915 | 3/1952 | Wullschleger | 212/58 R |
| 3,485,383 | 12/1969 | Beduhn | 212/48 |
| 3,842,984 | 10/1974 | Brown et al. | 212/49 |

OTHER PUBLICATIONS

"The Amazing American Sky Horse 900 Series Crane" by Amer. Hoist and Derrick Co. 12/9/71.

*Primary Examiner*—Robert J. Spar
*Assistant Examiner*—Lawrence J. Oresky
*Attorney, Agent, or Firm*—Cameron, Kerkam, Sutton, Stowell & Stowell

[57] ABSTRACT

A high capacity crane which has a wheeled or tracked chassis carrying a support structure rotatable about a vertical axis and including a jib and a counter-jib. An arcuate beam centered on the axis of rotation is anchored to the ground and carries a connector movable along the beam to which connector the counter-jib is in turn anchored.

8 Claims, 11 Drawing Figures

BALANCING SYSTEM FOR HIGH CAPACITY CRANES

REFERENCE TO RELATED APPLICATION

This application is a continuation-in-part of my application Ser. No. 384,175, filed July 31, 1972 now abandoned.

The object of the invention is an improved high-capacity crane having a balancing system. The invention is particularly applicable to cranes comprising a support structure mounted on caterpillar tracks or pneumatic tyres, rotatable about a vertical axis and carrying a jib on which run the working cables, and a counter-jib, the end of which is connected on the one hand to the end of the jib and on the other hand to an anchorage point positioned on a special balancing system.

Apparatus are, in fact, known which enables the capacity of this type of crane to be increased and consist, for example, of special counter-weights carried by a mobile carriage linked for rotation to the crane. This type of apparatus has the principal disadvantage of lifting the mobile counter-weight from its running surface, while on no load the counter-weight bears on its running surface. As a result, there is a swinging of the load on engagement which is deleterious to the precision required in this type of manoeuvre. Moreover, this type of apparatus requires a fairly well-levelled, horizontal running surface for the carriage to be able to move freely when the crane is turned. Furthermore, it is difficult to move the carriage away from the axis of rotation and this type of apparatus cannot, therefore, be used in practice for cranes on pneumatic tyres, the support chassies of which are particularly large.

The object of the invention is a crane with a novel balancing system, giving all the desirable guaranties of precision during operation, without this requiring more precise and, therefore, more difficult chocking of the crane assembly than is normally required to work with a large jib or under high load, with a normal mobile crane.

Furthermore, cranes with the balancing system are as suitable for mounting on caterpillar tracks as on pneumatic tyres. Lastly, the cranes with the balancing system can themselves carry the balancing system during movements of the cranes.

In accordance with the invention, the balancing system comprises a beam in the form of an arc of circle centered on the axis of rotation of the rotatable structure, means for anchoring the beam to the ground and a retaining cable secured to the end of the counter-jib and provided with an organ for securing onto the beam which can move along the said beam according to the orientation of the rotatable structure.

The invention will now be described with reference to several embodiments, given by way of example and illustrated in the attached drawings.

Figure 1:
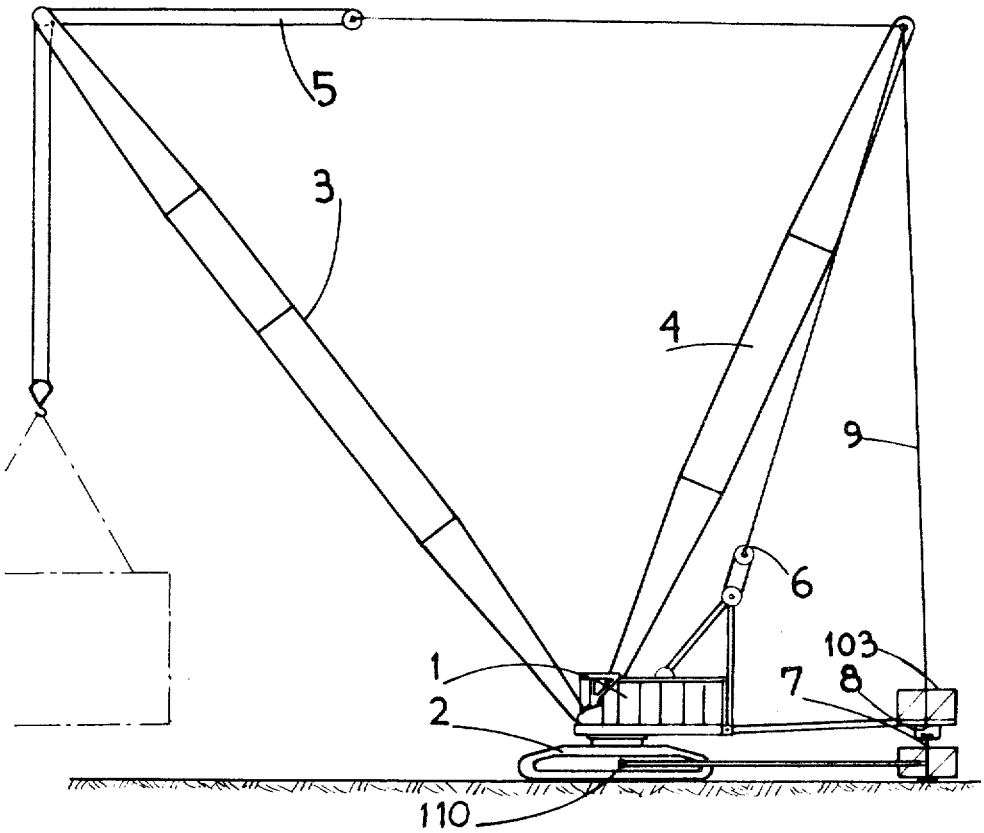
FIG. 1 is an elevation of an embodiment in accordance with the invention of a crane on caterpillar tracks fitted with a balancing system.

As shown, in particular, in FIGS. 1 to 4, the crane consists of a support structure 1 rotatable about a vertical axis on a chassis 2 and provided with equipment of large span designed to manipulate heavy loads at long distance or at great height, this equipment comprising a jib 3, a fixed framework counterjib 4, a pulley system 5 for varying the gradient of the jib relative to counterjib framework 4 and a pulley system 6 between the counterjib and the rear portion of the support structure, enabling the counterjib framework to be raised and placed in position.

Figure 2:
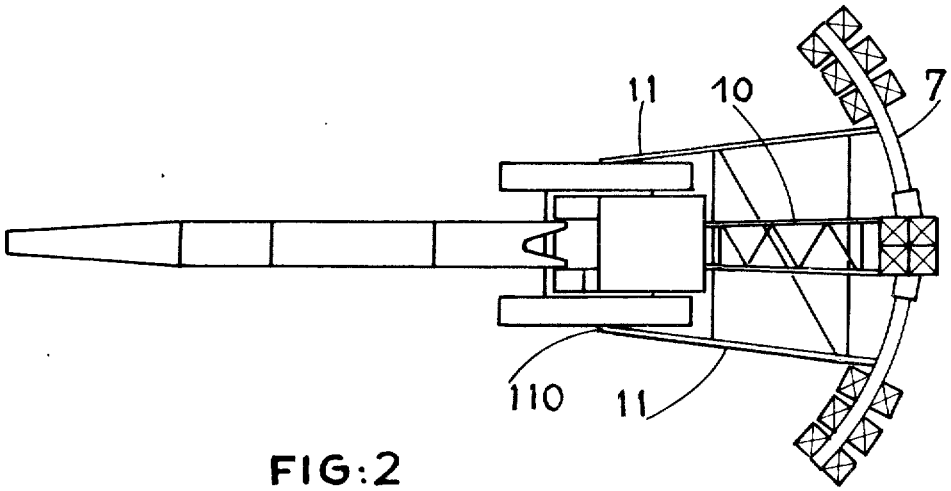
FIG. 2 is a plan of the crane of FIG. 1.
Figure 3:
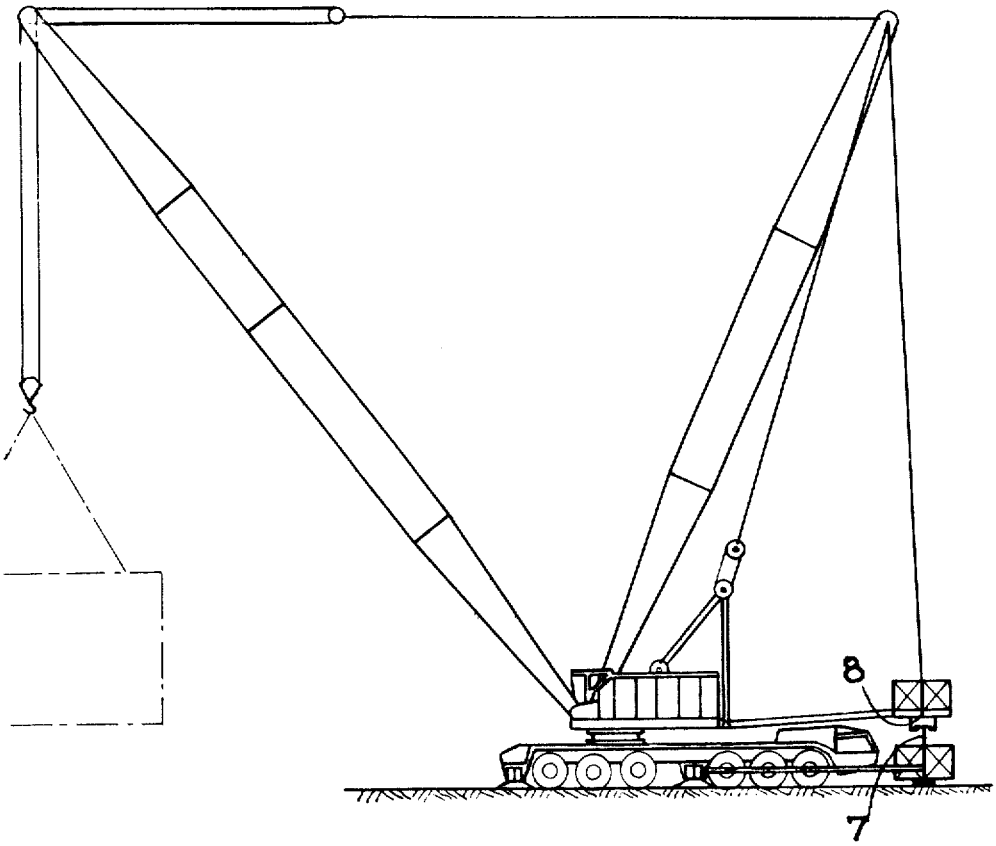
FIG. 3 is an elevation of an embodiment in accordance with the invention of a crane on pneumatic tyres fitted with a balancing system.
Figure 4:
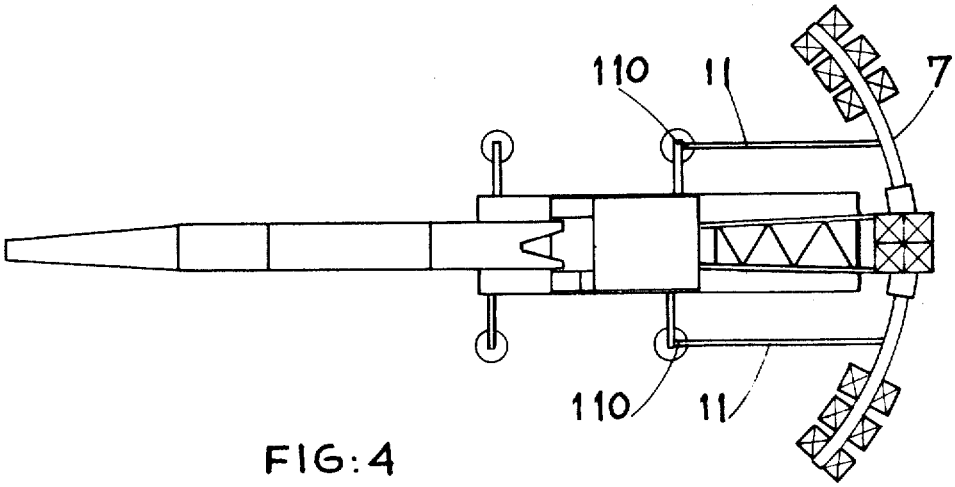
FIG. 4 is a plan of the crane of FIG. 3.

Chassis 2 can be mounted on a caterpillar track, as shown in FIGS. 1 and 2, or on pneumatic tyres, as shown in FIGS. 3 and 4.

The balancing system comprises a beam 7 in the form of an arc of circle, positioned on the rear of the crane, symmetrically relative to the axis of the chassis.

Figure 5:
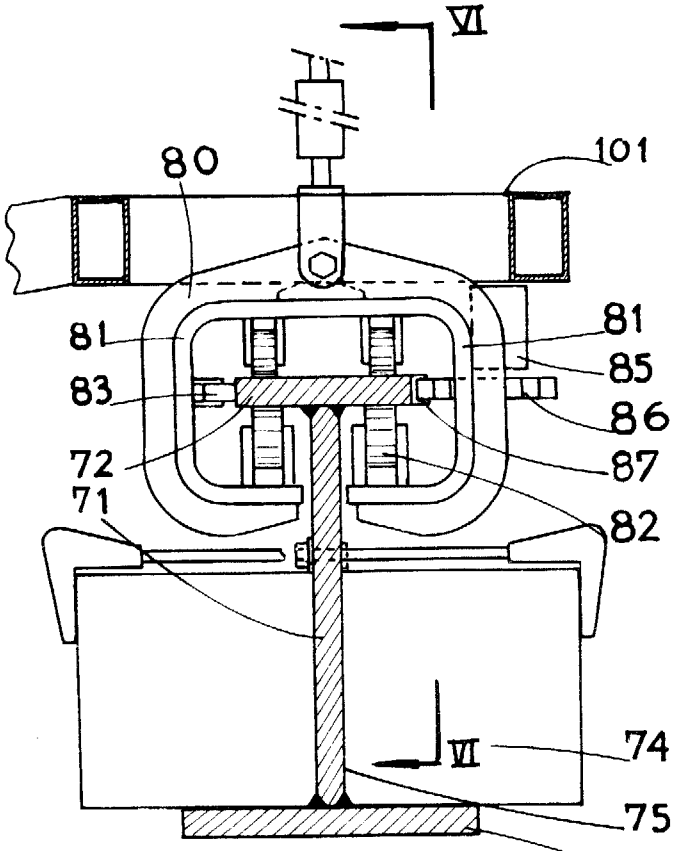
FIG. 5 is a cross-section of the securing organ of the balancing system.
Figure 6:
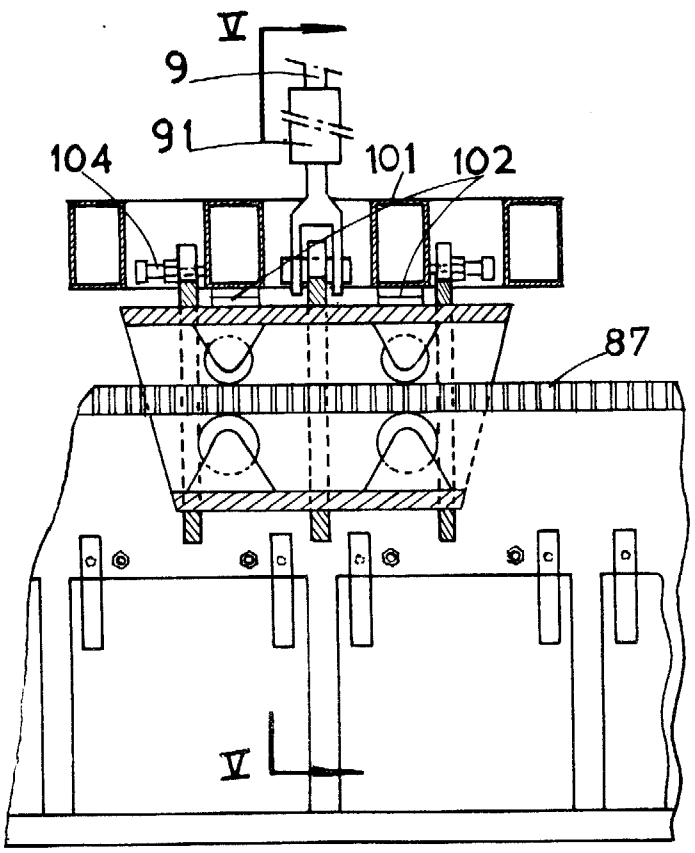
FIG. 6 is a longitudinal section of the securing organ.

Beam 7, shown in detail in FIGS. 5 and 6, can be an I girder, for example, consisting of a web 71 curved in an arc of a circle, welded to two flats 72 and 73 in the form of circular sectors and respectively forming the upper and lower flanges of the girder.

Lower flange 73 is used to anchor the part-circular girder. For example, the heads of anchoring bolts fixed in the ground may be made to bear on it, or else, as shown in the Figure, a series of additional counterweights 74 may be made to rest on it, distributed along the beam and held clamped against it by bolted cramps 75, or any other rapid anchoring means.

Flange 72 serves as a roller track for an anchoring device 8 in the form of a carriage 80 carried by rollers 82 running on the upper tread. The carriage, which is symmetrical relative to the web of the girder, comprises on either side of web 71, anchoring claws 81 which are curved downwards so as to pass under the flanges of upper tread 72, the lower ends of claws 81 carrying rollers 82 to run against the under-surface of tread 72.

Furthermore, rollers 83 with their axes vertical, are mounted on the carriage and centre the carriage relative to the girder by running on the lateral surface of flange 72.

A retaining stay 9 is fixed on the one hand to the upper end of counterjib 4 and on the other to anchoring device 8 by means of a swivel extended by a clevis, in which is engaged a pin received by an eye on a plate rigidly attached to carriage 8.

The carriage is also connected to the rotatable structure by two arms 10 (FIG. 2), which are strongly braced and pivoted on the rear portion of the rotatable structure. At their other ends, arms 10 are connected by struts 101 so as to form a frame over carriage 80. This frame bears on carriage 80 through localised supports made of plastics friction material 102. Moreover, the frame may act as a support for a certain amount of additional ballast 103 (FIG. 1).

An apparatus with adjustable, lateral stops, for example screws 104 bearing on the frame and on stops rigidly attached to the carriage, enables the carriage and pivoted framework to be connected for movement together during rotation.

As a result, the carriage can be driven by arms 10 and follow the orientation motions of the crane. However, it would be preferable to use an automotive securing carriage which, as shown in FIG. 5, could carry an hydraulic motor 85 driving a pinion 86, optionally through reduction gearing, pinion 86 engaging a toothed sector 87 formed on a lateral face of the girder, e.g. on the edge of flange 72. In this case, it is the motor of the carriage which will orientate the crane, hydraulic motor 85 being supplied with driving oil by elements fitted on the rotatable structure. This arrangement, which permits the rotational drive over the very large radius of the circular beam, allows very smooth starting and extreme manoeuvring precision.

One of the important characteristics of the invention is that two pulley systems each connected to a winch determine the position of the counter jib and the other orientation of the jib with respect to the counter jib. The interaction of these two pulley systems and of the retaining stay during the positioning of the crane overcomes the inconveniences of known systems of providing a resulting balance on lifting a load of the difference between the unloaded crane and the loaded crane.

Figure 9:
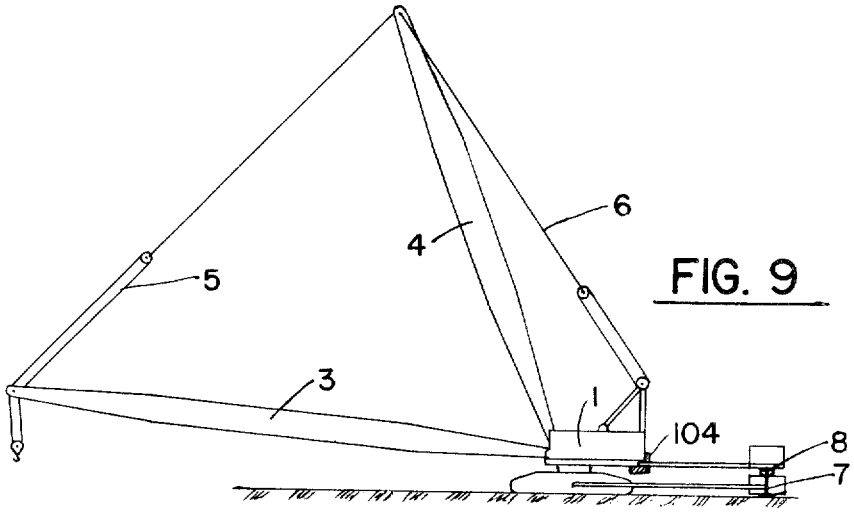
FIGS. 9, 10 and 11 show the successive stages of assembling the crane preparatory for work.
Figure 10:
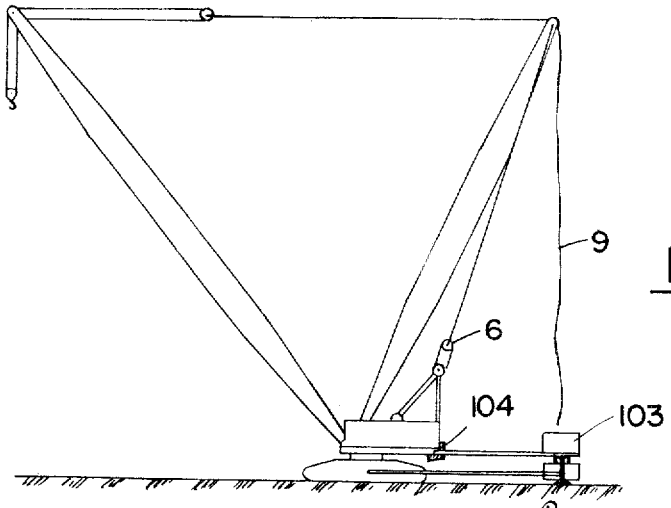
Figure 11:
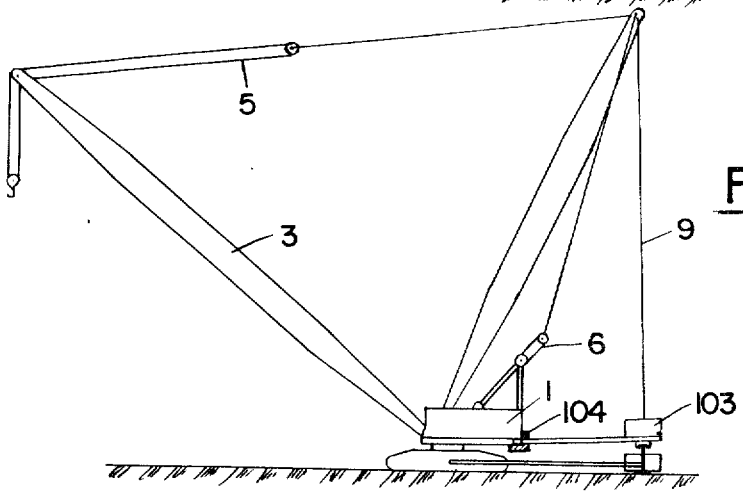

FIGS. 9, 10 and 11 show the operations in detail of the placing of the crane and its equipment in position for work.

At the start, when the equipment is assembled, the crane is in place with the jib 3 and the counter jib 4 on the ground connected by pulley system 5, pulley system 6 and the corresponding winches. Beam 7 and its anchoring device 8 are connected respectively by arms 11 to the chassis of the crane and arm 10 is connected to the rotating structure 1 of the crane, section 7 being anchored or loaded with counter weights necessary to the preparation to be performed.

As seen in FIG. 9, the first step consists of actuating the pulley system 6 by its winch which raises the counter jib 4 to a desired angle with the vertical by responding to the tensioning of the cables of the pulley system 5 by the corresponding winch.

At this time, the action of pulley system 6 causes the simultaneous raising of jib 3 with counter jib 4, pulley system 5 providing a predetermined angle between the jib and counter jib.

The action of pulley 6 is continued until the position is reached, as shown in FIG. 10, in which the counter jib 4 has reached a position in which the retaining stay 9, depending from the head of the counter jib, comes adjacent to its vertical position above the anchoring device 8 so that the retaining stay 9 can be connected to the anchoring device 8 by means shown in FIGS. 5 and 6. At this time, as can be seen in FIGS. 9 and 10, anchoring device 8 and counter weights 103 rest on the upper portion of the beam 7, the rotary structure being balanced only by the usual counter weight 104.

As soon as the retaining stay 9 is fixed to anchoring device 8, the winch actuating pulley system 6 is actuated to release the tension in pulley system 6. Continued lengthening of the pulley system 6 shifts the tension to retaining stay 9 connected to the anchoring device 8 as is seen in FIG. 11. Anchoring device 8 then bears, through it lower rollers 82, on sector 7 which is either counterweighted or anchored to the ground. Pulley system 6 at this time exerts no force and has no function. The orientation of jib 3, which determines the scope of action of the crane, is controlled by the winch connected to the pulley system 5.

The counter weights 103, when employed, are limited to a weight less than the tension in the retaining stay as determined by the weights of the unloaded jib 3 and counter jib, so that the anchoring device 8 is raised upon relaxing of the tension in pulley system 6.

The crane therefore provides a very high framework (the counter jib) directly anchored with respect to the earth on a sector permitting rotation of the crane.

The tension between a plurality of retaining stays, when used, can be equalized by structure 91.

The crane is now in position for operation.

Variation in the work distance of the crane is obtained by actuation of the winch controlling the pulley system 5.

Lifting of the load by the crane is carried out by the principal winch controlling the lifting pulley system. The weight of the load is transferred by an increase in the forces which occur in pulley system 5 between the jib and the counter jib and in the retaining stay 9. The anchoring device is already applied to the top of sector 7 by rollers 82 and there is no variation of position of the elements of the crane when the load is lifted except those which are normal and not excessive resulting from the elasticity of the jibs, retaining stays and pulley systems under the effect of the variation of the forces. It is to be noted that the pulley system 6 plays no part during the work of the crane handling loads. Thus, because of the direct anchoring to the earth of the counter jib, the lifting of a load requires no balancing of the crane.

Anchoring of the circular beam to the earth is easily done either by anchoring bolts secured in the ground or by counter weights greatly exceeding in weight the maximum forces which could occur in the retaining stay. The crane therefore has a remarkable stability and accuracy from the moment of lifting a load until deposit of the load.

Further, it is not necessary to provide the structure with an absolutely horizontal level as is generally required in analogous systems extending the scope of operation of the crane. Actually, the precision of location is on the order of that which is currently required for work with a long jib.

Another important advantage of the invention is the ability to displace the crane assembled with its circular beam and its anchoring device from one work location to another.

Part-circular girder 7 is in fact connected to the chassis of the crane by two arms 11, connected by struts and pivoted at their ends on girder 7 and on chassis 2. In the case of a crane on pneumatic tyres, shown in FIGS. 3 and 4, arms 11 will preferably be pivoted on the ends of the girders on which the lateral support plates of the crane are mounted.

Figure 7:
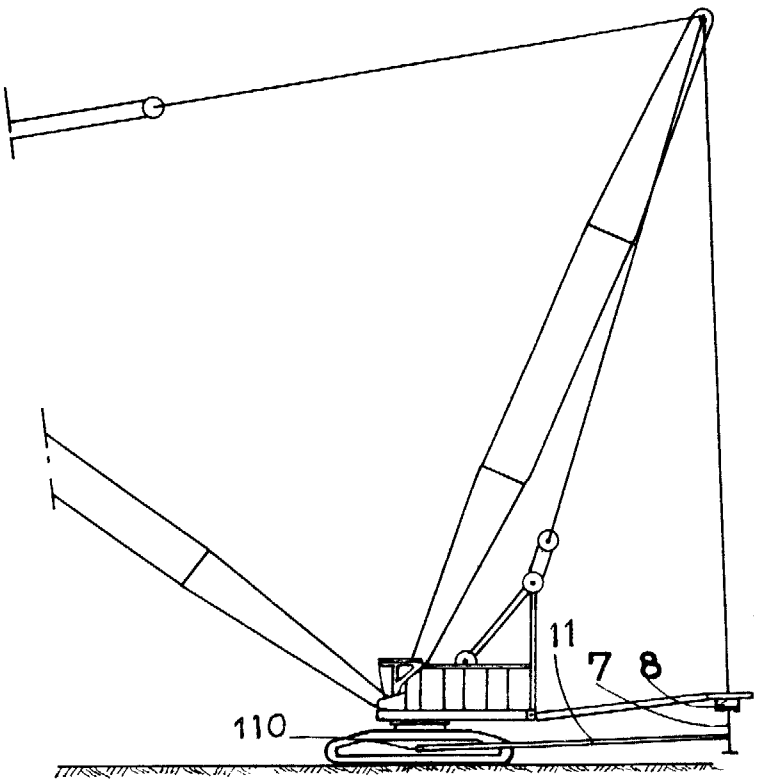
FIG. 7 is a view of a first method of transport of the balancing system.

With reference to FIG. 7, all that is necessary to move the crane in those circumstances is to release girder 7 from the anchorage bolts or counterweights which are holding it to the ground. With the jib placed in advance in a suitable position, operation of pulley-system 6 enables the circular girder to be lifted above the ground by rotation of connecting arms 11 on the chassis about horizontal pivot axes 110. The crane can then be moved to a new work site and so orientated that the axis of the chassis is directed towards the centre of the work zone. The part-circular girder, anchored to the ground by counterweights or by bolts fixed in a special emplacement provided for this purpose, will easily permit orientation of 45° on either side of the axis.

Figure 8:
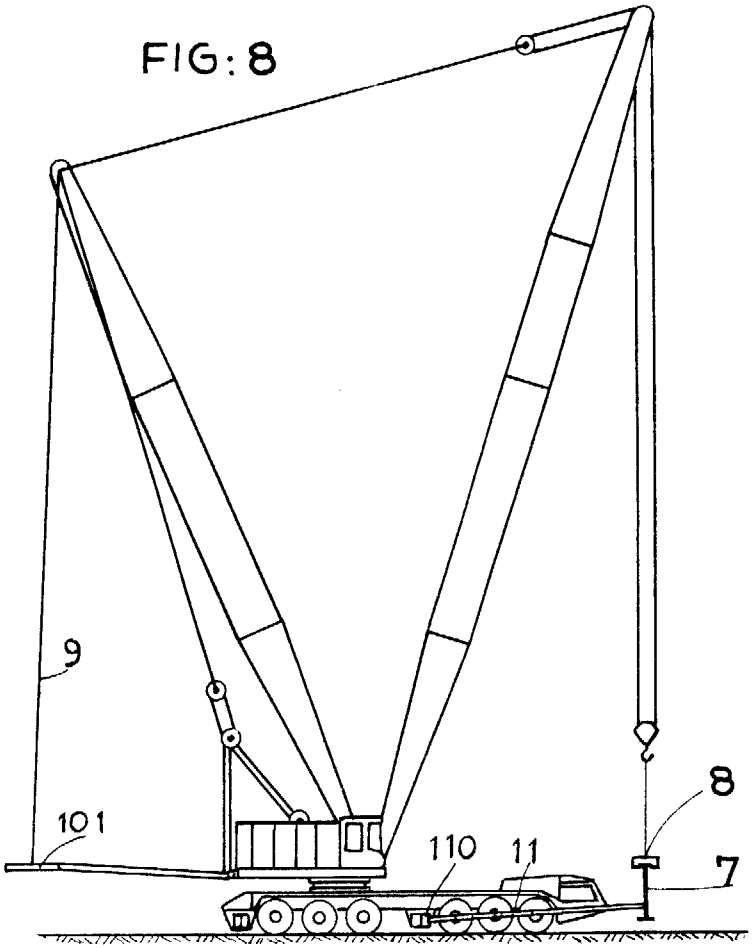
FIG. 8 is a view of a second method of transport of balancing system.

FIG. 8 shows another method of movement of the anchoring girder, in accordance with which arms 10 are supported by stay 9 secured to frame 101, girder 7 being suspended directly from the hook of the crane by means of securing device 8.

A further advantage of the crane balancing system described resides in the fact that it is particularly applicable to cranes on pneumatic tyres, despite the asymmetry of the chassies on the latter.

In fact, as shown in FIGS. 3 and 4, the part-circular girder can be positioned far enough from the axis of rotation to pass round the chassis on pneumatic tyres, even on the control cabin side.

Of course, the invention is not limited to the details of the embodiment described above, but on the contrary embraces all its conceivable modifications and equivalent means.

Thus the drive motor of the carriage of the securing device, which can be of any type, can drive the crane not only by gearing but also by friction, by cable winch drive, or by any other suitable means acting on the part-circular girder.

What I claim is:

1. A high-capacity crane comprising a support structure, a chassis mounted on ground engaging drive means and mounting said support structure for rotation about a vertical axis relative to said chassis, a jib and a counter jib pivotally mounted on said support structure, a hoisting cable connected to said jib for hoisting a load, an I-beam in the form of an arc of a circle spaced from and centered on the axis of rotation of said rotatable structure and positioned to be on the opposite side of said axis from said jib, an upper surface for said I-beam, means for releasably anchoring said beam to the ground, an anchoring device mounted for movement along said beam, carriage means for preventing vertical upward movement of said anchoring device relative to said beam as said anchoring device moves along said beam, at least one arm pivotally connected between said chassis and said beam, an arm pivotally connected between said anchoring device and said support structure, a retaining cable connecting the upper end of said counter jib to said device, said device moving along said beam according to the angular orientation of said rotatable structure, a variable length pulley system connected between said jib and said counter jib to adjust the inclination of said jib, a pulley system to adjust said counter jib connected between the upper end of said counter jib and said support structure, said pulley systems and said cable positioning said jib whereby said device exerts pressure beneath said upper surface before loading said jib, whereby when said releasable anchoring means is released from the ground the jib, counter jib, retaining cable and hoisting cable cooperate to lift the beam from the ground for transfer to other locations.

2. A crane in accordance with claim 1, said means for anchoring the beam to the ground including a series of detachable counterweights arranged along the beam and connected to said beam.

3. A crane in accordance with claim 1, said means for anchoring the beam to the ground including a series of bolts fixed in the ground, bearing on said beam and distributed along said beam.

4. A crane in accordance with claim 1, in which said securing device comprises a carriage, rollers for said carriage bearing on said upper surface of said beam and on either side of the web of said beam downwardly extending claws for said device engaging under said upper surface of said beam.

5. A crane in accordance with claim 4, including additional ballast mounted on said carriage.

6. A crane in accordance with claim 4, including guide rollers for said carriage engaging at least one lateral face of said beam.

7. A crane in accordance with claim 4, including independent drive means on said carriage for moving said carriage along said beam.

8. A crane in accordance with claim 7, said drive means including a motor fixed to said carriage and driving a pinion engaging a rack fixed along said beam.

* * * * *